US009121251B2

(12) United States Patent
Sommers et al.

(10) Patent No.: US 9,121,251 B2
(45) Date of Patent: Sep. 1, 2015

(54) VALVE FOR HYDRAULIC FRACTURING THROUGH CEMENT OUTSIDE CASING

(75) Inventors: Michael T. Sommers, Beggs, OK (US); Stephen L. Jackson, Eureka Springs, AR (US)

(73) Assignee: TEAM OIL TOOLS, LP, The Woodlands, TX (US)

( * ) Notice: Subject to any disclaimer, the term of this patent is extended or adjusted under 35 U.S.C. 154(b) by 306 days.

(21) Appl. No.: 13/602,428

(22) Filed: Sep. 4, 2012

(65) Prior Publication Data

US 2013/0056206 A1 Mar. 7, 2013

Related U.S. Application Data

(63) Continuation of application No. 13/223,909, filed on Sep. 1, 2011, now Pat. No. 8,267,178.

(51) Int. Cl.

| | |
|---|---|
| ***E21B 34/14*** | (2006.01) |
| ***E21B 43/26*** | (2006.01) |
| ***E21B 34/10*** | (2006.01) |
| *E21B 34/00* | (2006.01) |

(52) U.S. Cl.

CPC ..... *E21B 34/102* (2013.01); *E21B 34/103* (2013.01); *E21B 2034/007* (2013.01)

(58) Field of Classification Search

CPC ..... E21B 43/26; E21B 34/14
USPC ..... 166/373, 386, 317, 318, 332.1, 334.4, 166/285, 177.5, 308.1
See application file for complete search history.

(56) References Cited

U.S. PATENT DOCUMENTS

| | | | | |
|---|---|---|---|---|
| 2,251,977 | A | 8/1941 | Burt | |
| 3,381,756 | A * | 5/1968 | Reagan | 166/319 |
| 4,515,217 | A | 5/1985 | Stout | |
| 4,609,005 | A | 9/1986 | Upchurch | |
| 5,048,611 | A | 9/1991 | Cochran | |
| 5,261,486 | A | 11/1993 | Cornette | |
| 6,286,594 | B1 | 9/2001 | French | |
| 6,293,342 | B1 | 9/2001 | McGarian | |
| 6,464,008 | B1 | 10/2002 | Roddy | |
| 7,055,598 | B2 | 6/2006 | Ross | |
| 7,237,611 | B2 * | 7/2007 | Vincent et al. | 166/285 |
| 7,866,402 | B2 | 1/2011 | Williamson, Jr. | |
| 7,909,095 | B2 | 3/2011 | Richards et al. | |
| 7,926,573 | B2 | 4/2011 | Swan et al. | |
| 8,096,363 | B2 | 1/2012 | Williamson, Jr. | |
| 8,267,178 | B1 * | 9/2012 | Sommers et al. | 166/334.4 |
| 8,555,960 | B2 | 10/2013 | Mailand et al. | |
| 8,695,716 | B2 | 4/2014 | Ravensbergen | |
| 8,757,265 | B1 * | 6/2014 | Cuffe et al. | 166/308.1 |
| 2002/0121373 | A1 | 9/2002 | Patel | |
| 2002/0166665 | A1 | 11/2002 | Vincent et al. | |
| 2005/0072575 | A1 | 4/2005 | Yeo | |

(Continued)

FOREIGN PATENT DOCUMENTS

WO WO 2008091345 A1 * 7/2008

*Primary Examiner* — Kenneth L Thompson
(74) *Attorney, Agent, or Firm* — MH2 Technology Law Group, LLP

(57) ABSTRACT

A valve for use in fracing through cement casing in a well allows for flow of cement down the well during the cementing process and in the open position allows for fracing fluid to be directed through the cement casing for fracturing the formation adjacent the valve. The valve is constructed so as to reduce the likelihood of the valve to jam as a result of cement or other foreign material.

17 Claims, 4 Drawing Sheets

(56) References Cited

U.S. PATENT DOCUMENTS

| | | | | |
|---|---|---|---|---|
| 2007/0272411 | A1 | 11/2007 | Lopez De Cardenas | |
| 2008/0302538 | A1 | 12/2008 | Hofman | |
| 2009/0044944 | A1 * | 2/2009 | Murray et al. | 166/308.1 |
| 2009/0095463 | A1 | 4/2009 | Swan et al. | |
| 2009/0095486 | A1 | 4/2009 | Williamson, Jr. | |
| 2010/0314562 | A1 | 12/2010 | Bisset | |
| 2011/0174491 | A1 | 7/2011 | Ravensbergen et al. | |
| 2012/0279723 | A1 | 11/2012 | Hofman et al. | |
| 2014/0076578 | A1 | 3/2014 | Hofman et al. | |
| 2014/0116721 | A1 | 5/2014 | Hofman et al. | |
| 2014/0251636 | A1 | 9/2014 | Hofman et al. | |

* cited by examiner

VALVE FOR HYDRAULIC FRACTURING THROUGH CEMENT OUTSIDE CASING

CROSS-REFERENCE TO RELATED APPLICATIONS

This is a continuation of co-pending U.S. patent application Ser. No. 13/223,909, entitled "Valve for Hydraulic Fracturing Through Cement Outside Casing", filed Sep. 1, 2011, in the name of the inventors Michael Sommers and Stephen Jackson. The earlier effective filing date of that application is hereby claimed pursuant to 35 U.S.C. §120.That application is also hereby incorporated by reference for all purposes as if set forth herein verbatim.

BACKGROUND

1. Field of the Invention

This invention is directed to a valve utilized for hydraulically fracturing multiple zones in an oil and gas well without perforating the cement casing. A relatively new oil/gas well completion method involves the use of a valve that is installed as pan of the easing string of the well and provides for cement flow within the casing when the valve element is in a closed position and allows for axial flow of fracturing fluid through the cement casing to fracture the formation near the valve. The invention disclosed herein is an improved valve used in this process.

2. Description of Related Art

Current designs for valves used in the completion method disclosed above are prone to failure because cement or other debris interferes with the opening of the valve after the cementing process has been completed. Portions of the sliding sleeve or pistons commonly used are exposed to either the flow of cement or the cement flowing between the well bore and the casing string.

SUMMARY OF THE INVENTION

The valve according to the invention overcomes the difficulties described above by isolating a sliding sleeve between an outer housing and an inner mandrel. A rupture disk in the inner mandrel ruptures at a selected pressure. Pressure will then act against one end of the sliding sleeve and shift the sleeve to an open position so that fracturing fluid will be directed against the cement casing. The sliding sleeve includes a locking ring nut to prevent the sleeve from sliding back to a closing position.

DETAILED DESCRIPTION

Figure 1:
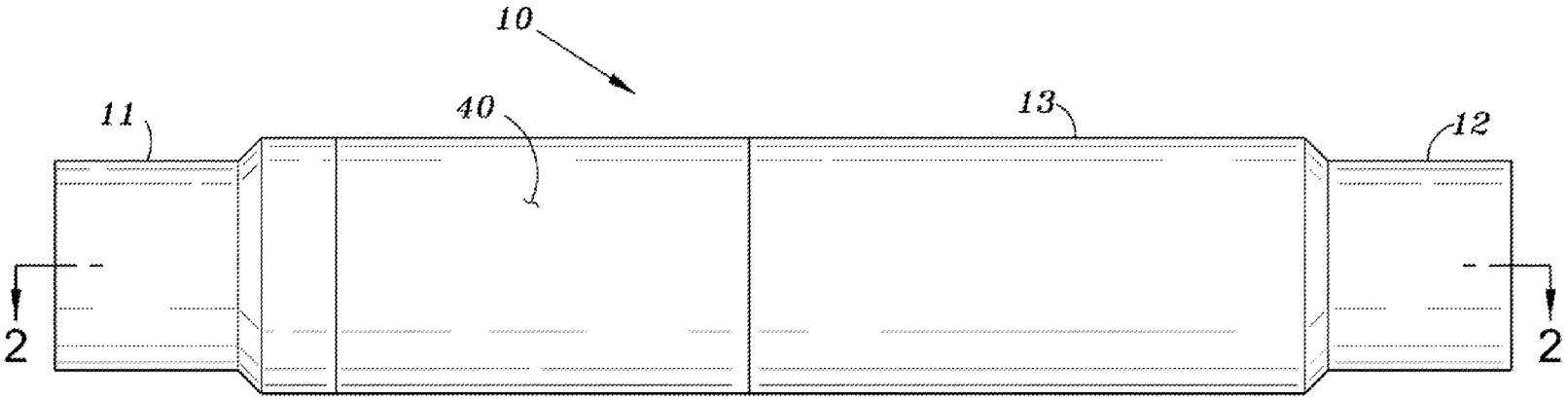
FIG. 1 is a side view of the valve according to one embodiment of the invention.

As shown in FIG. 1, an embodiment of valve 10 of the invention includes a main housing 13 and two similar end connector portions 11, 12.

Main housing 13 is a hollow cylindrical piece with threaded portions 61 at each end that receive threaded portions 18 of each end connector. End connectors 11 and 12 may be internally or externally threaded for connection to the casing string. As show in FIG. 2, main housing 13 includes one or more openings 19, which are surrounded by a circular protective cover 40. Cover 40 is made of a high impact strength material.

Figure 2:
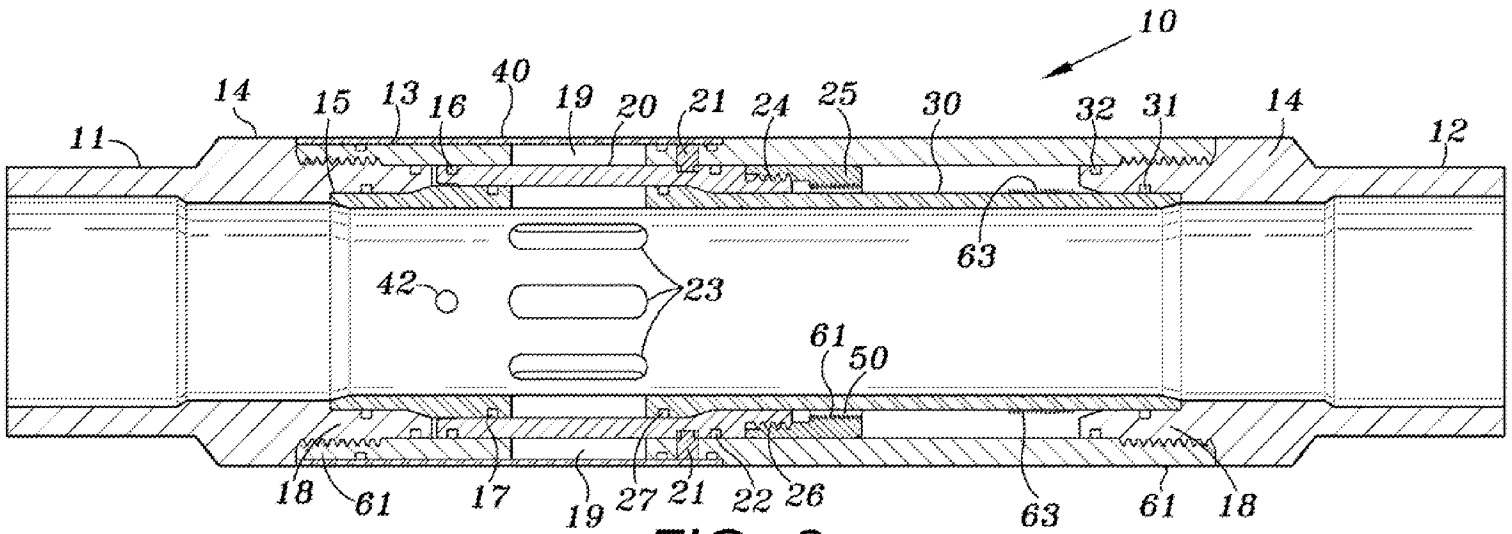
FIG. 2 is a cross sectional view of the valve in the closed position taken along line 2-2 of FIG. 1
Figure 3:
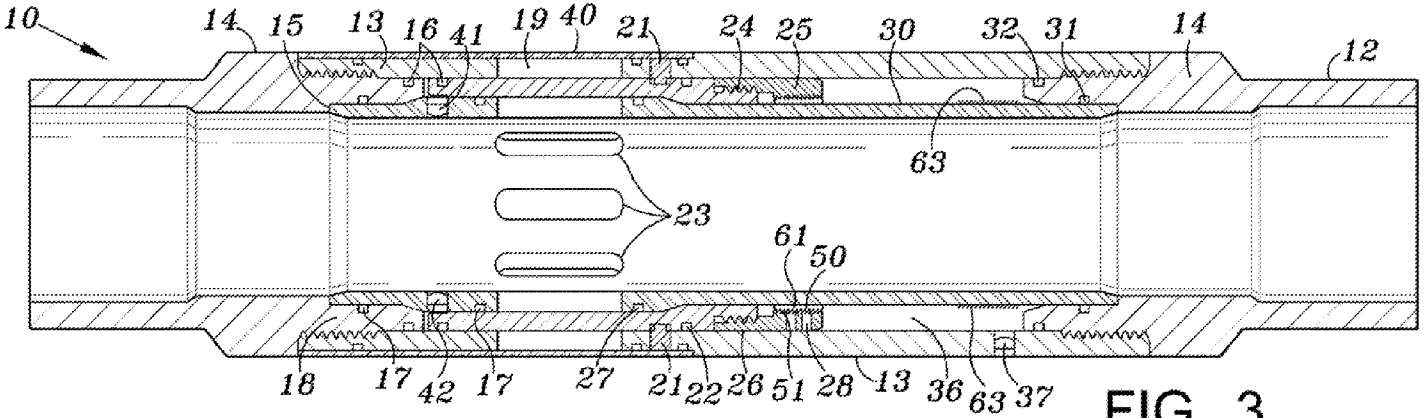
FIG. 3 is a cross sectional view of the valve taken along line 3-3 of FIG. 2

Valve 10 includes a mandrel 30 which is formed as a hollow cylindrical tube extending between end connectors 11, 12 as shown in FIG. 2. Mandrel 30 includes one or more apertures 23 that extend through the outer wall of the mandrel. Mandrel 30 also has an exterior intermediate threaded portion 51. One or more rupture disks 41, 42 are located in the mandrel as shown in FIG. 3. Rupture disks 41, 42 are located within passageways that extend between the inner and outer surfaces of the mandrel 30. Annular recesses 17 and 27 are provided in the outer surface of the mandrel for receiving suitable seals.

Figure 4:
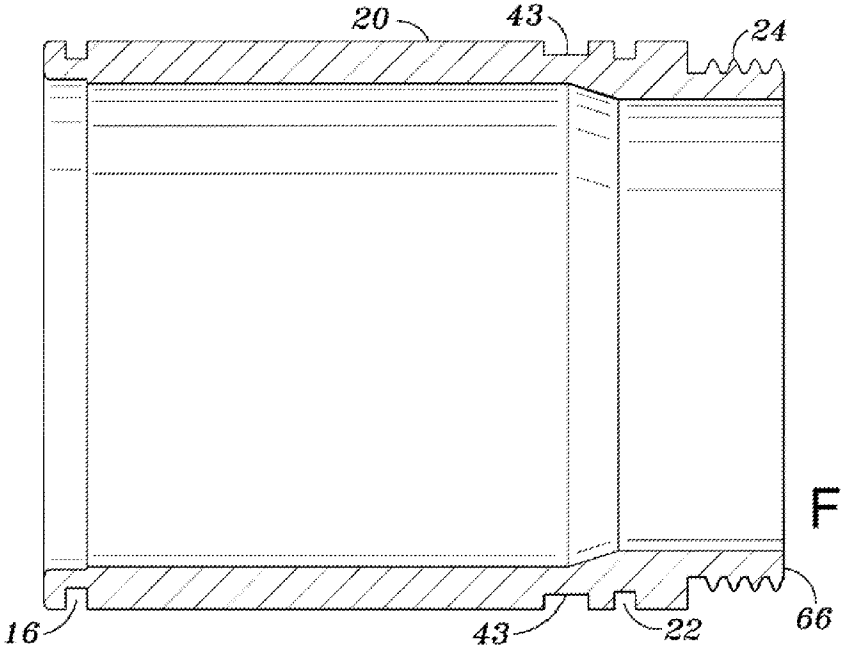
FIG. 4 is a cross sectional view of the sliding sleeve
Figure 5:
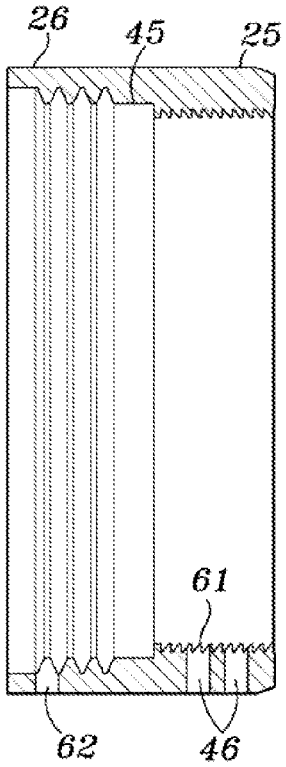
FIG. 5 is a cross sectional view of the locking ring holder
Figure 6:
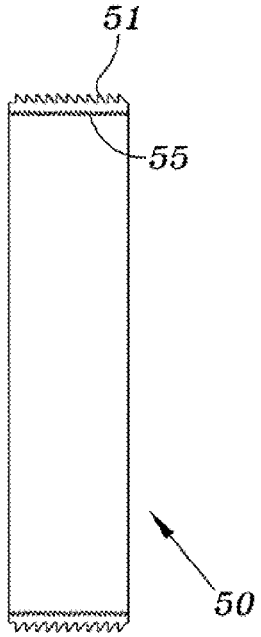
FIG. 6 is a cross sectional view of the locking ring

Mandrel 30 is confined between end connectors 11 and 12 by engaging a shoulder 15 in the interior surface of the end connectors. End connectors 11 and 12 include longitudinally extending portions 18 that space apart outer housing 13 and mandrel 30 thus forming a chamber 36. Portions 18 have an annular recess 32 for relieving a suitable seal. A sliding sleeve member 20 is located within chamber 36 and is generally of a hollow cylindrical configuration as shown in FIG. 4. The sliding sleeve member 20 includes a smaller diameter portion 24 that is threaded at 66. Also it is provided with indentations 43 that receive the end portions of shear pins 21. Sliding sleeve member 20 also includes annular grooves 16 and 22 that accommodate suitable annular seals.

Figure 7:
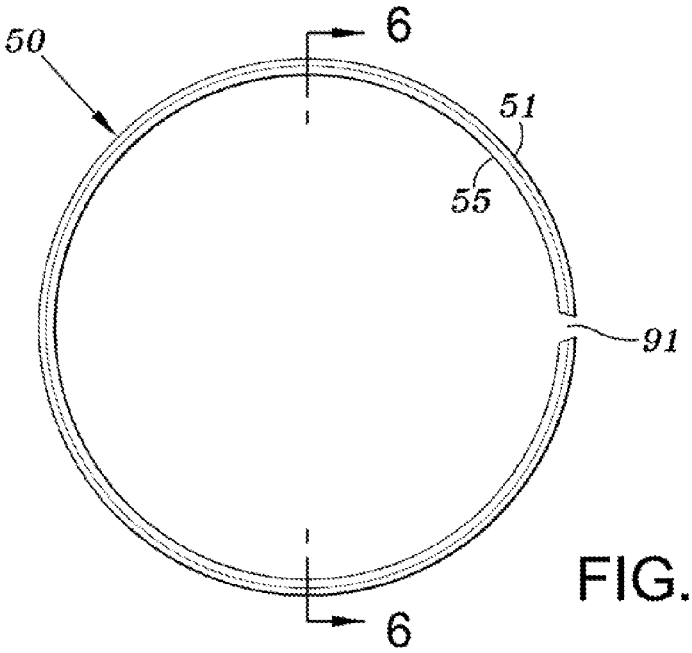
FIG. 7 is an end view of the locking ring
Figure 8:
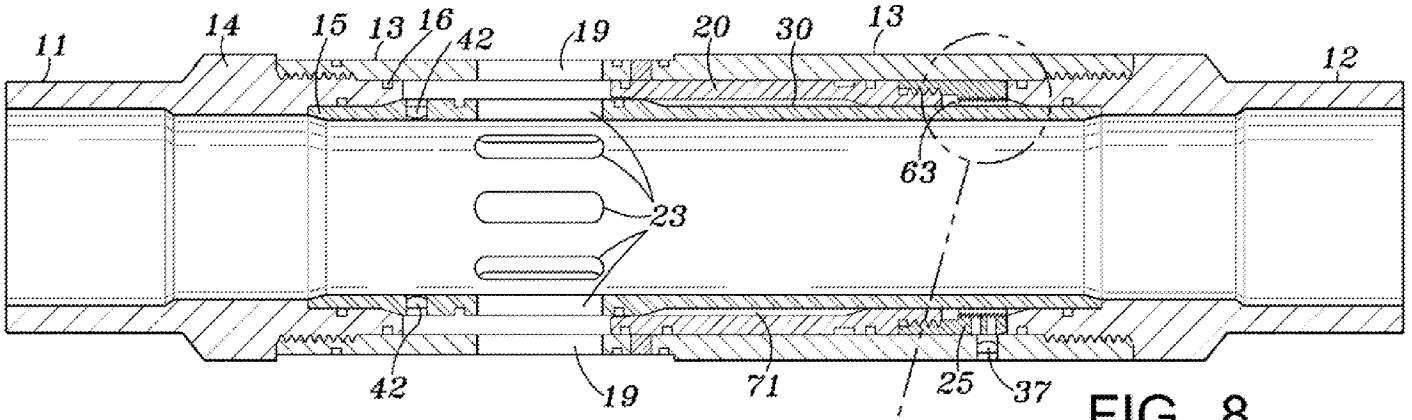
FIG. 8 is a cross sectional view of the valve in the open position
Figure 9:
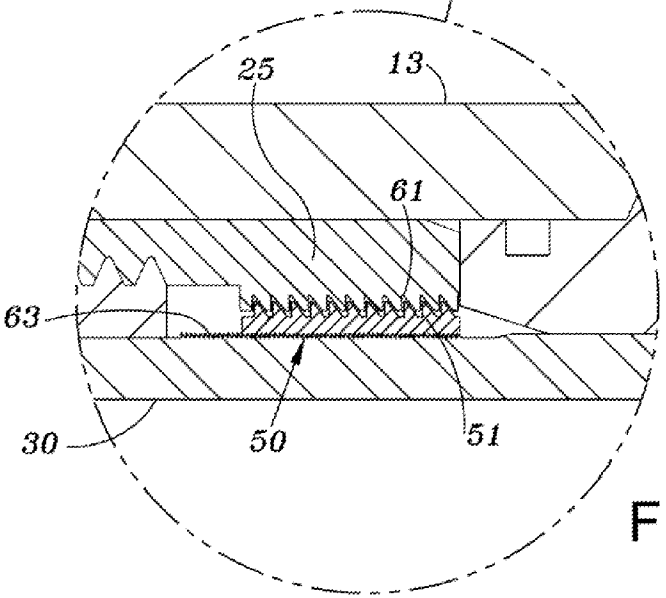
FIG. 9 is an enlarged view of the area circled in FIG. 8.

A locking ring holder 25 has ratchet teeth 61 and holds locking ring 50 which has ratchet teeth 51 on its outer surface and ratchet teeth 55 on its inner surface shown in FIG. 9. Locking ring 50 includes an opening at 91 as shown in FIG. 7 which allows it to grow in diameter as the sliding sleeve moves from the closed to open position.

Locking ring holder 25 has sufficient diameter clearance so that the locking ring can ratchet on the mandrel ratcheting teeth 63 yet never loose threaded contact with the lock ring holder. Locking ring holder 25 is threaded at 26 for engagement with threads 24 on the mandrel. Locking ring holder 25 also has a plurality of bores 46 and 62 for set screws, not shown.

In use, valve 10 may be connected to the casing string by end connectors 11, 12. One or more valves 10 may be incorporated into the easing string. After the casing string is deployed within the well, cement is pumped down through the casing and out the bottom into the annulus between the well bore and the casing as typical in the art. After the cement flow is terminated, a plug or other device is pumped down to wipe the casing and valve clean of residual cement. When the plug or other device has latched or sealed in the bottom hole assembly, pressure is increased to rupture the rupture disk at a predetermined pressure. The fluid pressure will act on sliding sleeve member 20 to cause the shear pins to break and then to move it downward or to the right as shown in FIG. 7. This movement will allow fracing fluid to exit via opening 23 in the mandrel and openings 19 in the outer housing. The fracing fluid under pressure will remove protective cover 40 and crack the cement casing and also fracture the foundation adjacent to the valve 10.

Due to the fact that the sliding sleeve member 20 is mostly isolated from the cement flow, the sleeve will have a lessor tendency to jam or require more pressure for actuation.

In the open position, locking ring 50 engages threads 63 on the mandrel to prevent the sleeve from moving back to the closed position.

A vent 37 is located in the outer housing 13 to allow air to exit when the valve is being assembled. The vent 37 is closed by a suitable plug after assembly.

Although the present invention has been described with respect to specific details, it is not intended that such details should be regarded as limitations on the scope of the invention, except to the extent that they are included in the accompanying claims.

What is claimed is:

1. A valve comprising:

a housing having an opening;

a mandrel positioned within the housing and having an opening, a second opening and an inner bore, wherein the opening and the second opening are in communication with the inner bore;

a sliding sleeve disposed between the housing and the mandrel and blocking fluid communication between the opening in the housing and the opening in the mandrel when the valve is in a closed position and permitting fluid flow between the opening in the mandrel and the opening in the housing when the valve is in an open position; and a rupture disk that, upon rupture, permits application of a fluid pressure to actuate the sliding sleeve from the closed position to the open position, wherein the rupture disk is disposed in the second opening and is ruptured by pressure applied from the inner bore and radially outward through the second opening.

2. The valve as claimed in claim 1, wherein the second opening is in a wall of the mandrel.

3. The valve as claimed in claim 1, further comprising an end connector on each end of the housing for connection in a casing string in an oil or gas well.

4. The valve as claimed in claim 1, wherein the housing and the mandrel define a chamber between them in which the sliding sleeve is disposed.

5. A valve comprising:

a housing having an opening;

a mandrel positioned within the housing and having an opening;

a sliding sleeve disposed between the housing and the mandrel and blocking fluid communication between the opening in the housing and the opening in the mandrel when the valve is in a closed position and permitting fluid flow between the opening in the mandrel and the opening in the housing when the valve is in an open position;

a rupture disk that, upon rupture, permits application of a fluid pressure to actuate the sliding sleeve between the open and closed positions; and a protective sleeve covering the openings in the housing.

6. A method for actuating a valve, the method comprising:

flowing a fluid through the valve, the valve comprising;

a housing having one or more openings;

a mandrel having one or more openings;

a sliding sleeve disposed between the housing and the mandrel and blocking fluid communication between the openings in the housing and the openings in the mandrel when the valve is in a closed position and permitting fluid flow between the openings in the mandrel and the openings in the housing when the valve is in an open position; and a rupture disk that, upon rupture, applies a fluid pressure to move the sliding sleeve from the closed position to the open position;

rupturing the rupture disk at a selected fluid pressure;

flowing fluid through the ruptured disk;

moving the sliding sleeve responsive to the fluid pressure from the closed position to the open position;

exiting fluid through the one or more openings of the housing and mandrel; and cracking a cement casing with the fluid.

7. The method of claim 6, further comprising pumping cement through the valve into a wellbore.

8. The method of claim 7, further comprising wiping the valve with a plug.

9. The method of claim 6, wherein the sliding sleeve is isolated between the housing and the mandrel.

10. A casing string valve for use in fracturing operations, comprising:

a housing having a first opening therein fluidly connecting an interior of the housing with an exterior of the housing;

a mandrel having a bore therethrough defining a cement flow path and having a second opening and a third opening, the second opening defining with the first opening a fracturing fluid flow path between the bore and the exterior of the housing, and the third opening being in communication with the bore, the mandrel being disposed within the housing to define in conjunction with the housing a chamber isolated from the cement flow path;

a sliding sleeve disposed between the housing and the mandrel, at least partially isolated from the cement flow path in the chamber, wherein the sliding sleeve is moved from a first position in which the sliding sleeve blocks fluid flow between the first opening and the second opening to a second position in which the sliding sleeve does not block fluid flow between the first and second openings by fluid pressure applied through the bore and outwards though the third opening; and a rupture disk disposed within the third opening to selectively control the application of fluid pressure through the third opening.

11. The casing string valve of claim 10, further including an end connector on each end of the housing for connection in a casing string in an oil or gas well.

12. A casing string valve for use in fracturing operations, comprising:

a housing having a first opening therein fluidly connecting an interior of the housing with an exterior of the housing;

a mandrel having a bore therethrough defining a cement flow path and having a second opening and a third opening, the second opening defining with the first opening a fracturing fluid flow path between the bore and the exterior of the housing, the mandrel being disposed within the housing to define in conjunction with the housing a chamber isolated from the cement flow path;

a sliding sleeve movable to block and unblock the fracturing fluid flow path, the sliding sleeve disposed between the housing and the mandrel, at least partially isolated from the cement flow path in the chamber, and actuated by application of fluid pressure applied through the bore and the third opening; and a protective sleeve covering the openings in the housing.

13. A method for use in hydraulically fracturing a well, comprising:

disposing a casing string in a wellbore, the casing string including a valve having a bore therein and defining a cement flow path and a fracturing fluid flow path, the fracturing fluid flow path being blocked and unblocked by a sliding sleeve of the valve at least partially isolated from the cement flow path and disposed at least partially around and radially outwards from the bore;

cementing the casing string within the wellbore through the cement flow path while the fracturing fluid flow path is blocked;

applying a fluid pressure through the bore of the valve to actuate the sliding sleeve and unblock the fracturing fluid flow path; and introducing a fracturing fluid into the wellbore through the fracturing fluid flow path.

14. The method of claim 13, wherein the sliding sleeve is at least partially isolated from the cement flow path by disposition between a mandrel and a housing in a chamber defined by the mandrel and the housing that is isolated from the cement flow path.

15. The method of claim 13, further comprising cracking a cement casing with the introduced fracturing fluid.

16. The method of claim 13, further comprising wiping the valve with a plug after the cementing and prior to applying the fluid pressure.

17. A method for use in hydraulically fracturing a well, comprising:

disposing a casing string in a wellbore, the casing string including a valve defining a cement flow path and a fracturing fluid flow path therethrough, the fracturing fluid flow path being blocked and unblocked by a sliding sleeve of the valve at least partially isolated from the cement flow path and disposed at least partially around and radially outwards from the bore;

cementing the casing string within the wellbore through the cement flow path while the fracturing fluid flow path is blocked;

applying a fluid pressure through the bore of the valve to actuate the sliding sleeve and unblock the fracturing fluid flow path, wherein applying the fluid pressure includes rupturing a rupture disk; and introducing a fracturing fluid into the wellbore through the fracturing fluid flow path.

* * * * *